United States Patent [19]

Micheletti

[11] 4,151,729

[45] May 1, 1979

[54] CIRCULAR KNITTING MACHINE HAVING A PATTERN DRUM COAXIAL AND UNDERLYING THE NEEDLE CYLINDER

[75] Inventor: Fabrizio Micheletti, Fucecchio, Italy

[73] Assignee: Brematex S.p.A., Florence, Italy

[21] Appl. No.: 817,374

[22] Filed: Jul. 20, 1977

[30] Foreign Application Priority Data

Jul. 20, 1976 [IT] Italy ..... 9529 A/76

[51] Int. Cl.[2] ..... D04B 15/74

[52] U.S. Cl. ..... 66/216; 66/231; 66/55

[58] Field of Search ..... 66/154 R, 14, 55, 50 B, 66/59, 154 A

[56] References Cited

U.S. PATENT DOCUMENTS

| | | | |
|---|---|---|---|
| 1,306,523 | 6/1919 | Childrey | 66/154 R X |
| 2,301,065 | 11/1942 | Mills | 66/50 B |
| 2,749,728 | 6/1956 | Griesbach | 66/154 R X |
| 3,141,316 | 7/1964 | McCarthy et al. | 66/154 A |

*Primary Examiner*—Werner H. Schroeder
*Assistant Examiner*—Andrew M. Falik
*Attorney, Agent, or Firm*—Richards, Shefte & Pinckney

[57] ABSTRACT

A circular knitting machine having a program or pattern drum coaxial and underlying the needle cylinder. The pattern drum is advanced intermittently and selectively by pawls engaging ratchet wheels of different pitch on the drum, with the pawls driven with different strokes though shafts parallel with the cylinder axis and oscillated by followers riding on cams on the needle cylinder, the followers being selectively and independently displaceable by electro-mechanical units to produce intermittent operation of the pattern drum. Cams on the drum act through followers mounted on shafts coaxial with the cylinder axis to oscillate operating arms for controlling radial cams for needle and jack butt manipulation, for controlling an arm with an inclined surface for displacing the cylinder to adjust the length of the loop being knit, and for controlling other instrumentalities of the machine. A yarn cutting device is mounted above the cylinder for free rotation and for lowering for driven engagement of an annular resilient friction member on the underside of the device by the cylinder through the knit fabric, thereby rotating the device to effect cutting of the knitting yarn.

4 Claims, 32 Drawing Figures

100
98
7
94
96
104
92
106
140
3
108
118
5
92
10
92A
80
76
34
78
77
62
3
38
85A
40
24
82
90
24A
74
83
64A
88
42
64
66
56
70
52
68A
68
72
54
14
124
44
46
50
122
57
48
52
50A
50
122
124

Fig. 26
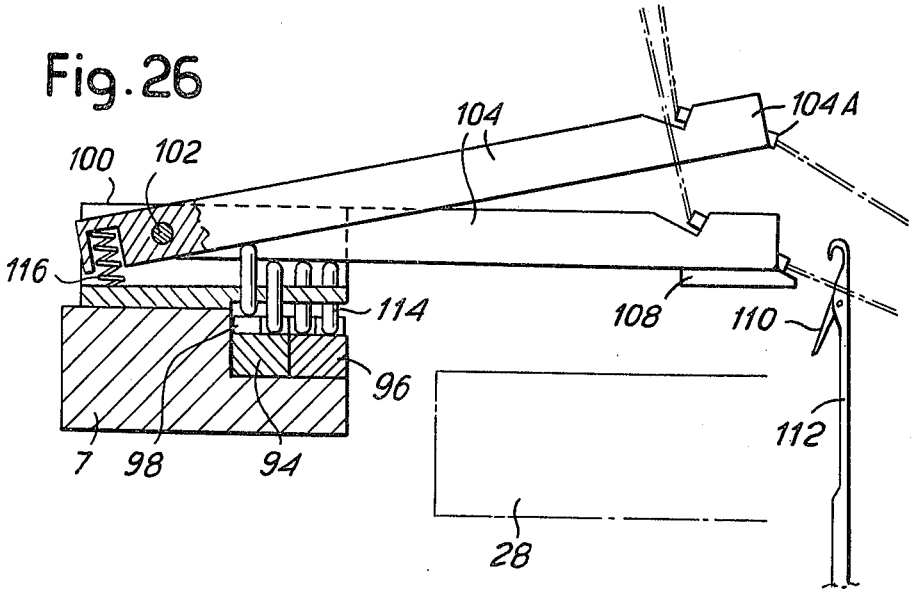
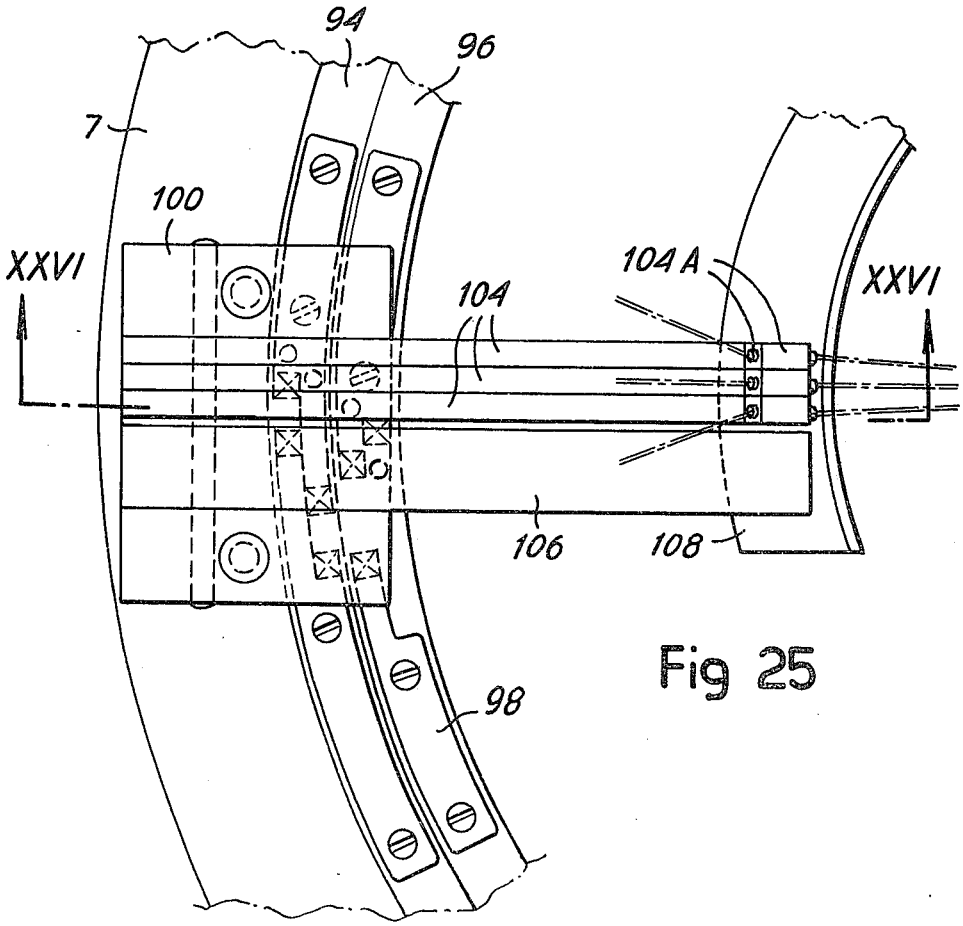
Fig 25

CIRCULAR KNITTING MACHINE HAVING A PATTERN DRUM COAXIAL AND UNDERLYING THE NEEDLE CYLINDER

BACKGROUND OF THE INVENTION

The present invention relates to patterning means for circular knitting machines, and more particularly to pattern drums for circular knitting machines of the rotating cylinder type.

Various types of pattern drums and associated drum operating mechanisms and drum driven mechanism have been developed over the years. These drums are conventionally located on the machine adjacent the needle cylinder and connected operably thereto by various compound linkages that are complicated to design, construct and maintain.

In contrast, the present invention provides a patterning means that is simple and reliable in design and can be easily maintained and adjusted using simple and direct connections and that can be simply and easily driven from the needle cylinder directly without any complex drive mechanism or linkage.

SUMMARY OF THE INVENTION

Briefly described the patterning means of the present invention is incorporated in a circular knitting machine of the rotating needle cylinder type and includes a pattern drum rotatably mounted on the machine coaxial with and underlying the needle cylinder, and means responsive to needle cylinder rotation and engageable with the pattern drum to advance the pattern drum. With this coaxial and underlying pattern drum disposition, the pattern drum can be driven simply and effectively from the needle cylinder and simple and reliable linkages can be utilized from the coaxial pattern drum to control operation of the knitting machine instrumentalities.

Preferably the aforementioned responsive means includes cam means mounted on the cylinder and follower means engageable with the cam means in following relation thereto and operable to advance the pattern drum in response to the following relation. Ratchet means, preferably in the form of a plurality of ratchet wheels having different pitches, is mounted on the pattern drum and the follower means includes pawl means, preferably in the form of a plurality of pawls imparting different strokes to the ratchet wheels, engageable with the ratchet means to advance the pattern drum. Means are also provided for intermittently deactivating the follower means to produce intermittent operation of the pattern drum, which deactivating means may be in the form of a plurality of deactivating devices connected to the followers for selectively and independently displacing the followers out of cam following relation.

In the preferred embodiment of the present invention, the cylinder cam followers and the ratchet pawls are connected directly and simply by shafts rotatably mounted on the machine parallel to the cylinder and drum axis for transmission of oscillating motion from the followers to the pawls. The same type of simple and reliable parallel shaft connections are utilized to connected cam and follower means associated with the pattern drum and arms that engage operating instrumentalities of the machine such as a radial cam that engages needle or jack butts, or through an inclined surface engagement displaces the cylinder axially upon oscillation of an associated shaft to adjust the length of the loop being knit by the machine.

BRIEF DESCRIPTION OF THE DRAWINGS

FIG. 25 is an enlarged plan view of one set of yarn feed fingers and associated instrumentalities of the machine of FIG. 1;

FIG. 26 is a vertical sectional view taken along line XXVI—XXVI of FIG. 25;

DETAILED DESCRIPTION OF THE PREFERRED EMBODIMENT

Figure 1:
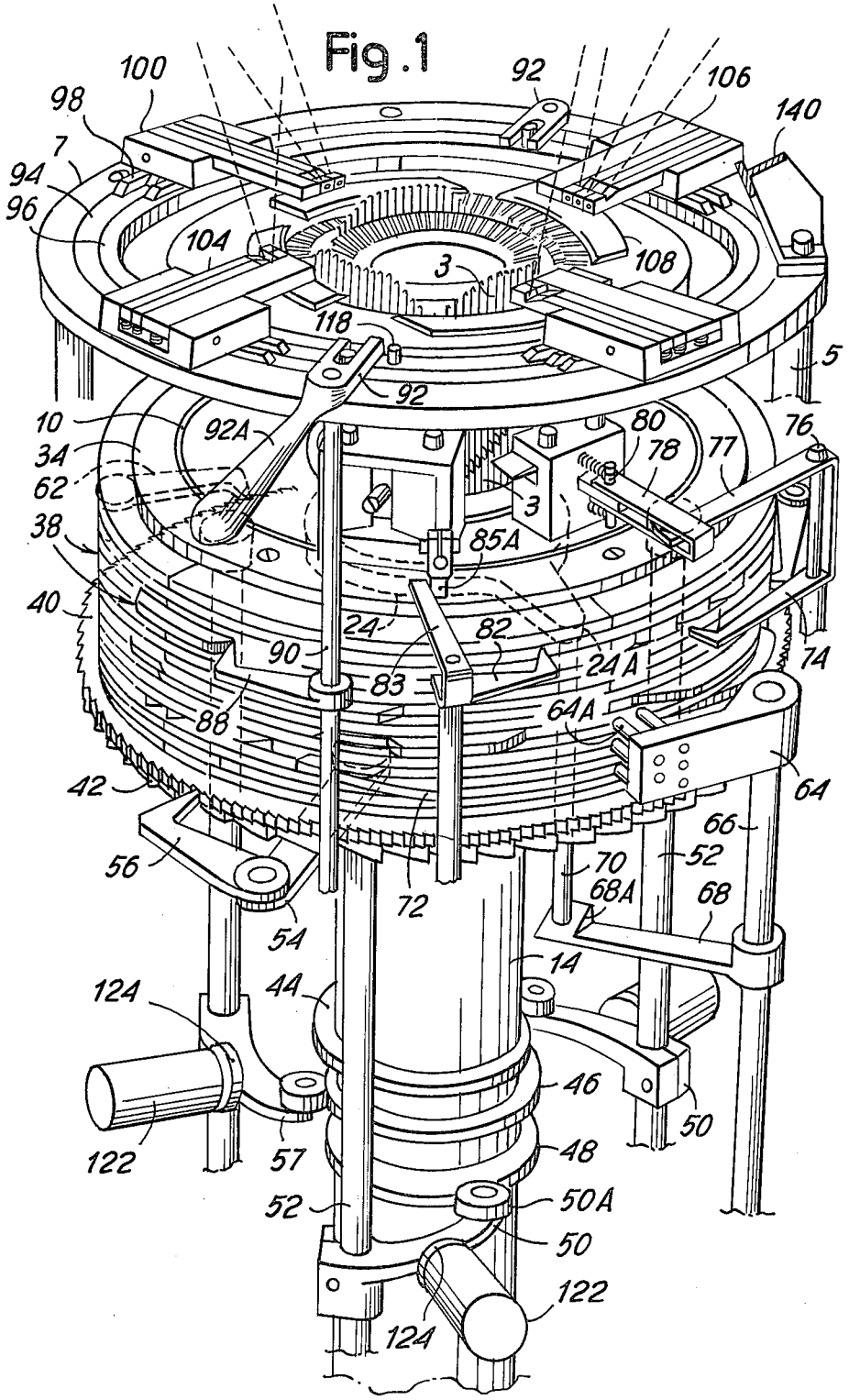
FIG. 1 is a perspective view of the pertinent portions of a knitting machine incorporating the preferred embodiment of the present invention.
Figure 2:
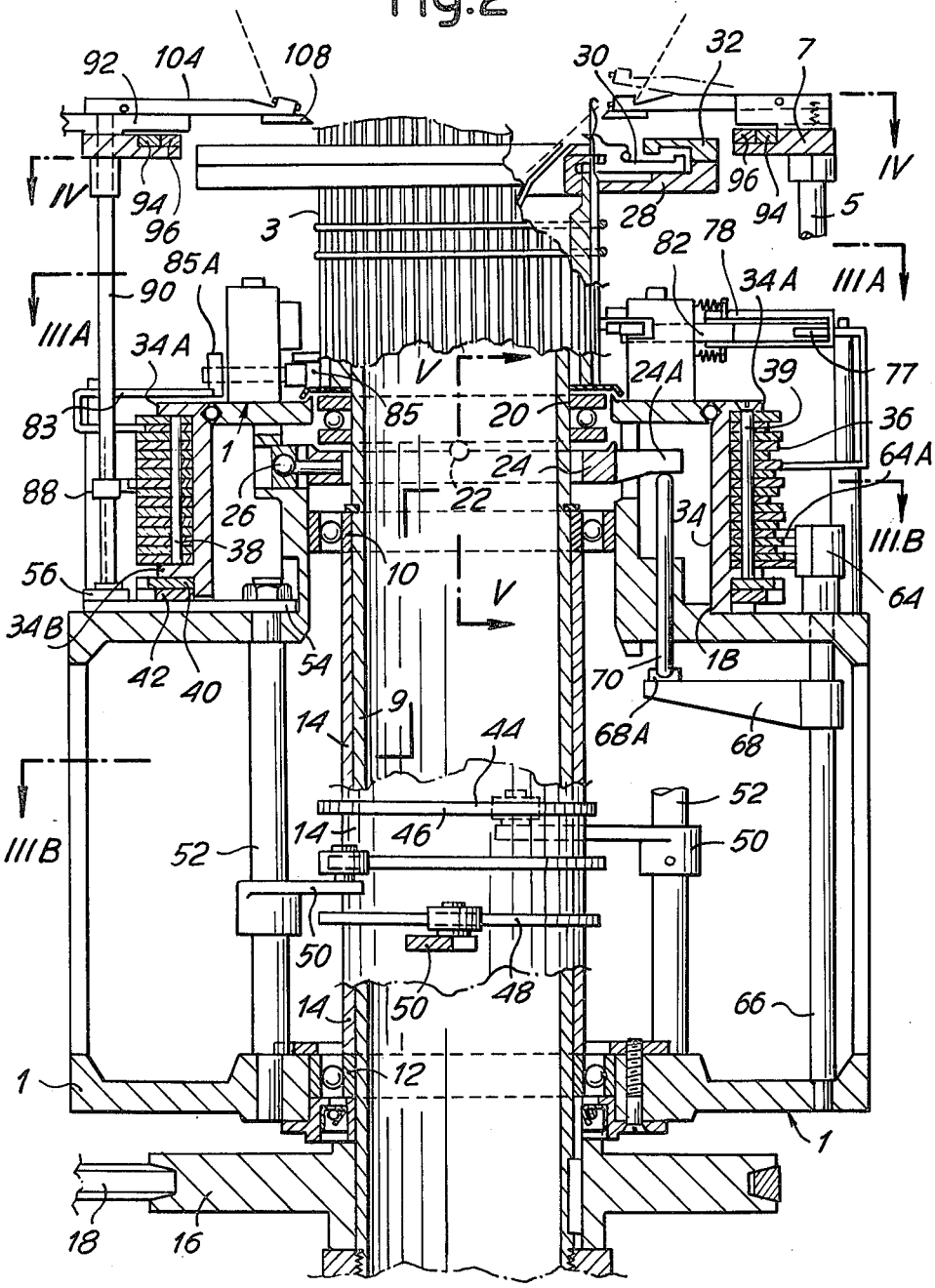
FIG. 2 is an elevation view, partially in section, of the portion of the knitting machine shown in FIG. 1.
Figure 3A:
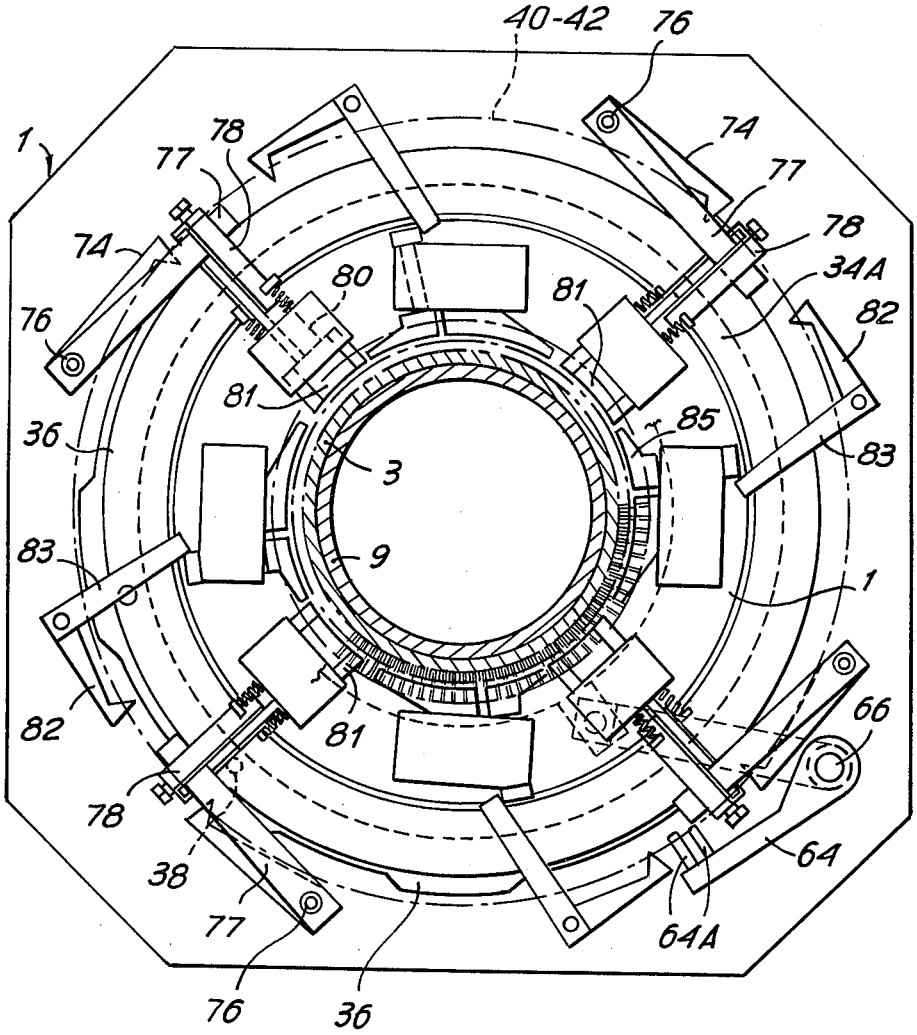
FIGS. 3A, 3B and 4 are horizontal section views taken along lines IIIA—IIIA, IIIB—IIIB and IV—IV of FIG. 2.
Figure 3B:
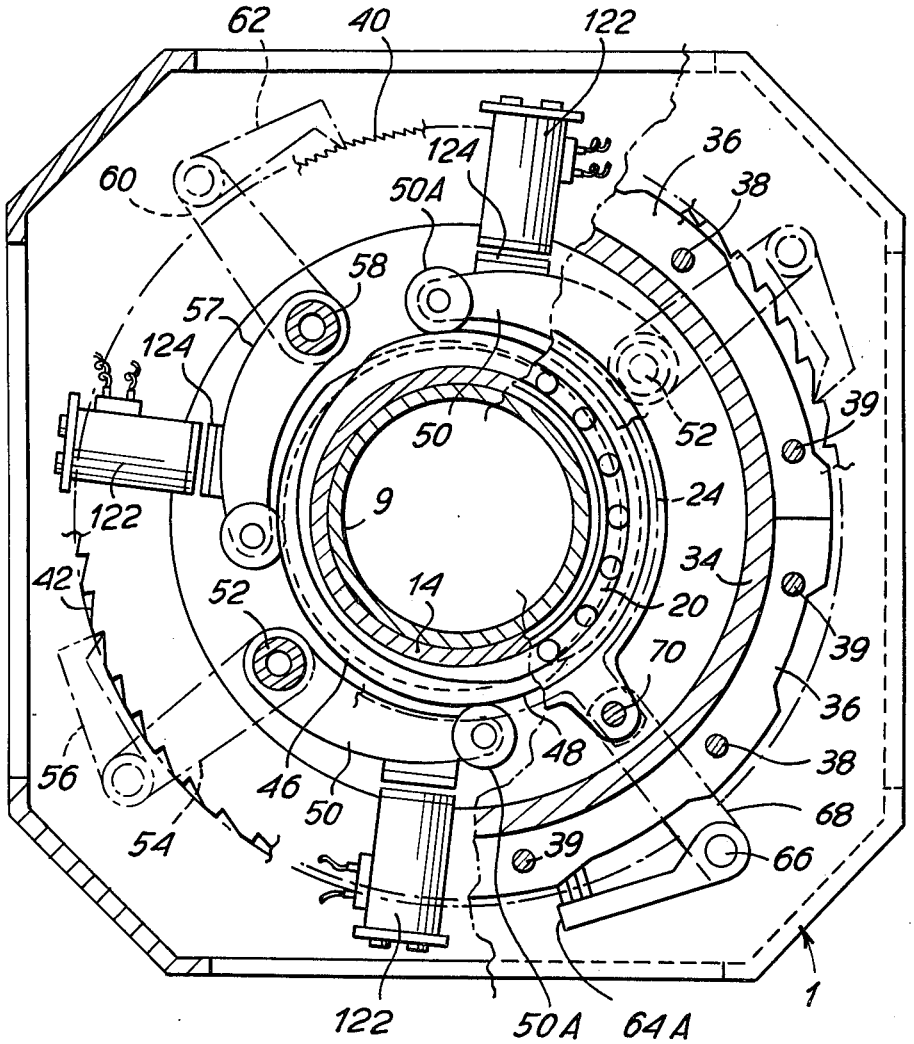
Figure 5:
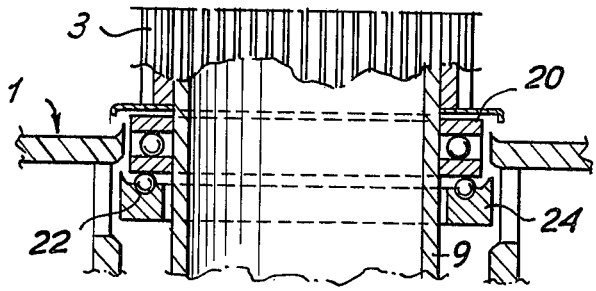
FIG. 5 is a vertical section taken along line V—V of FIG. 2.
Figure 6:
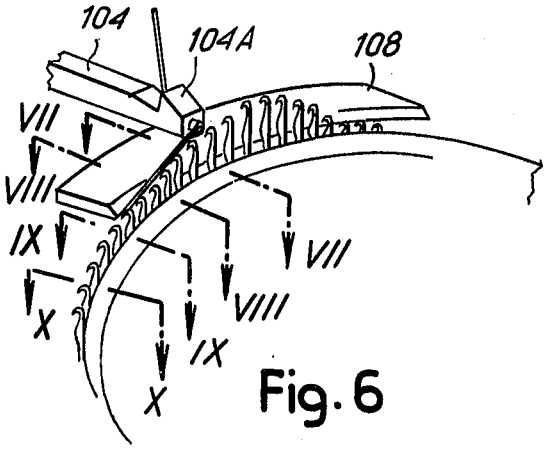
FIG. 6 is an enlarged perspective view of a series of needles, a latch guide plate and the end of a feed finger that feeds yarn to the needles.
Figure 7:
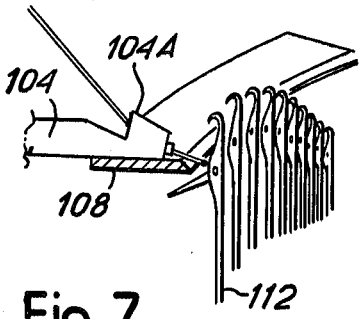
FIGS. 7, 8, 9 and 10 are perspective section views taken along lines VII—VII, VIII—VIII, IX—IX and X—X, respectively of FIG. 6.
Figure 8:
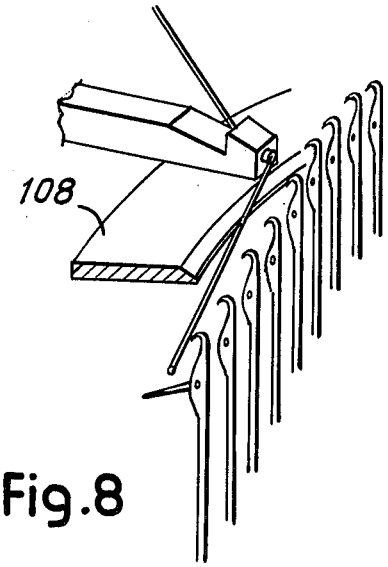
Figure 9:
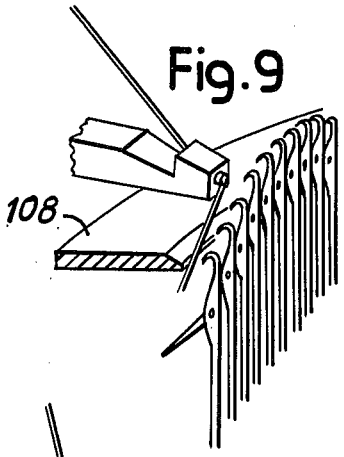
Figure 10:
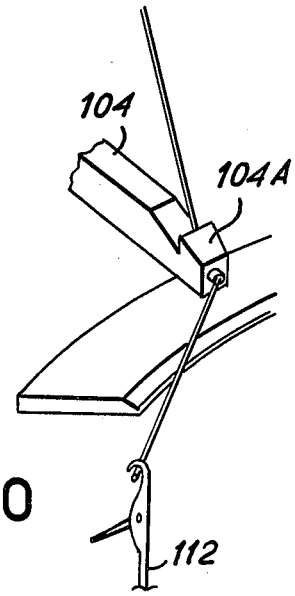
Figure 11:
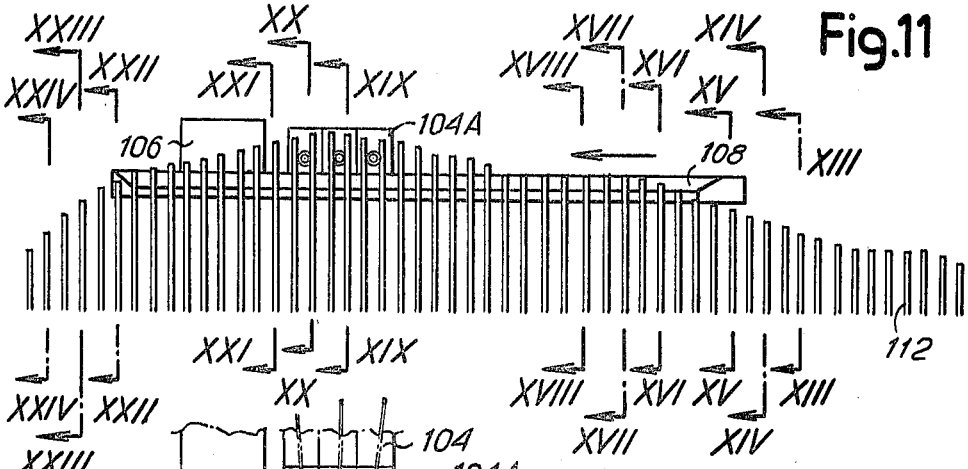
FIG. 11 is an elevational development view of the needles, latch guide and yarn feed fingers as viewed facing one set of feed fingers of the machine of FIG. 1.
Figure 12:
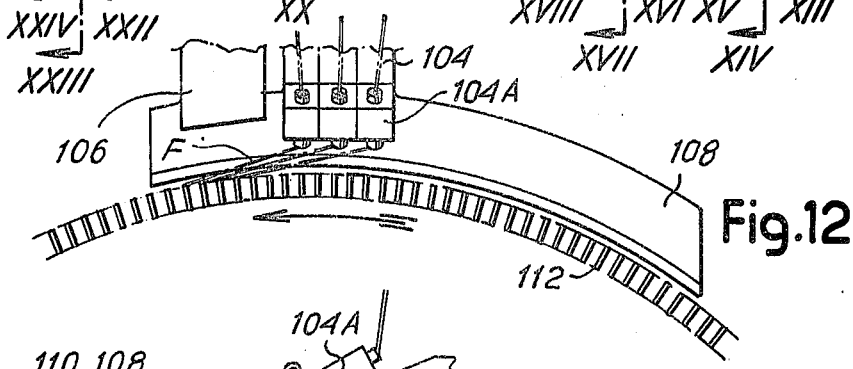
FIG. 12 is a plan view of the elements of FIG 11.
Figure 22:
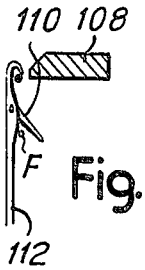
FIGS. 13-24 are vertical section views taken along lines XIII—XIII through XXIV—XXIV of FIG. 11.
Figure 19:
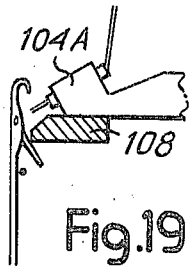
Figure 16:
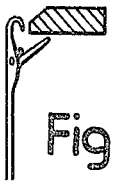
Figure 13:
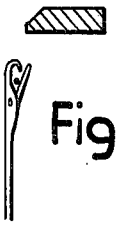
Figure 23:
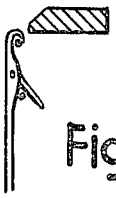
Figure 20:
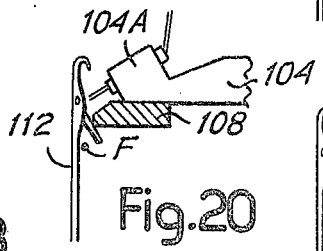
Figure 17:
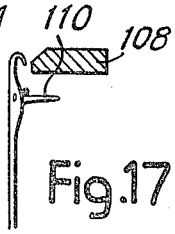
Figure 14:
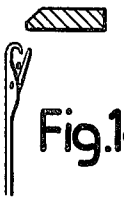
Figure 24:
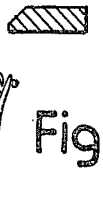
Figure 21:
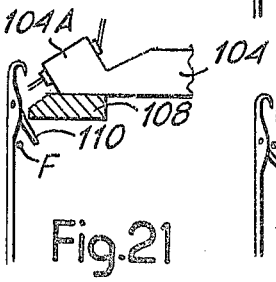
Figure 18:
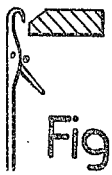
Figure 15:
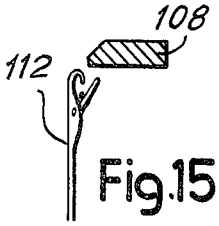

In the accompanying drawing, 1 generically denotes a main supporting frame or mounting for a needle cylinder 3. In FIG. 1 this frame 1 is mostly omitted for clearness's sake. An annular element 7 is supported onto the frame by means of columns 5, with the annular element surrounding the needle cylinder upper end area. The needle cylinder 3 is slidably assembled but rotatably coupled to a tubular shaft 9 which is mounted on the frame 1 by means of radial bearings 10 and 12 that are mounted on the shaft 9 with annular spacers 14 intermediate the shaft and bearings. The shaft 9 and supported cylinder 3 are rotatably driven through a pulley 16 mounted on the shaft 9 and around which is trained a drive belt 18. The cylinder 3 by means of an axial bearing 20 bears on small diametrically opposed balls 22 borne by a ring 24 (also see FIG. 5) that is pivoted at 26 to the frame 1 peripherally intermediate the small balls 22 and has at its end opposite to the pivot 26 an operative extension 24A actuated in a hereinafter described manner to vary the axial position of the cylinder and thereby the length of the loop of yarn being knit. At the upper end of the needle cylinder 3 a sinker ring 28 is mounted for control of sinkers 30, according to a conventional arrangement and sinker operating cam means are provided on a smaller ring 32, mounted on the sinker ring 28 in a position angularly fixed and axially movable with the cylinder 3.

A program or pattern drum 34 is mounted on the frame 1 coaxial with and underlying the needle cylinder by means of a step 1B and a circular wall 10. The drum 34 is slowly rotatable independent of the cylinder 3 and in the hereinafter indicated manner for operating a jack control system and other instrumentalities. The drum 34 has a wide outer groove or race defined by flanges 34A, 34B and designed to accommodate a plurality of radial cams in the form of superimposed plates stacked within the groove between the flanges 34A and 34B. In particular, provisions may be made for packs of cams 36 developed according to annular sectors, and engaged to one another, for instance, by a stem 38 which engages them temporarily one to the other to aid the assembly of the sector cam packs 36 within the annular groove or race of the drum 34. The cams pack 36 is locked by means of a pair of screws 39 which pass through the upper flange 34A and are screwed to the lower flange 34B, thus locking the sector cam pack 36. Through this arrangement, the cam can be easily mounted and disassembled with respect to the drum 34 carrying them, by presenting the drum in a given accessible position, by removing the screws 39 and taking away the sector cam pack 36, and by introducing a new pack of sector cams according to the desired arrangement, and reassemblying the screws 39 to lock the cam pack to the drum 34. In the groove between the flanges 34A and 34B a plurality of cams can be mounted which are aligned sector by sector to define annular tracks a radial cams for hereinafter indicated controls.

The pattern drum 34 is actuated with a slow rotation by a ratchet mechanism driven by the needle cylinder motion to control the working knitting cycle with the advancement or stop of the drum 34 controlled according to a program which supplies electric stoppage and start signals.

For the advancement of the drum 34, it has mounted thereon two ratchet wheels 40 and 42 having inclined teeth, the wheel 40 having much closer teeth than those on the wheel 42. The machine program provides for the rotation by a full revolution of the drum 34 with the cams 36, at each production of an article. Three cams 44, 46, 48 are coupled in a rotary manner to and positioned on the tubular shaft 9 by spacers 14. Each of the cams 44 and 48 act on the roller 50A of a follower 50, which is assembled on a shaft 52 parallel to the axis of the needle cylinder. At the upper end, each of the two shafts 52 carries an arm 54, a pawl 56 being linked to the outer end thereof and being stressed resiliently against the lower ratchet wheel 42 having more spaced teeth. The two pawls 56 and the associated actuation cams are in such mutual relationship that at each half-revolution of the needle cylinder two successive advance movements are imparted to the ratchet wheel and thus to the drum, to obtain an averagely uniform motion. A similar arrangement with a follower 57 cooperates with the cam 46 to determine the actuation of a shaft 58 similar to the one 52 for an arm 60 actuating a pawl 62 designed to act on the ratchet wheel 70 having closer teeth. This arrangement of pawls imparts very slow angular movements to the drum 34 for the control of the follower 57.

The movements of the pattern drum caused by the pawls 50, 56 serve to obtain movements of the instrumentalities associated with the needle cylinder 3. The slow movement obtained with the pawls 57, 62 serves to vary the axial position of the needle cylinder and thus to vary the length of the loops being knit. Since the variation of the loop length must be very slow, recourse is had to the pawl acting on the ratchet wheel 40 having very close saw-teeth. In order to determine this axial movement of the needle cylinder for the above-indicated purpose, the cams which are the lowest in the pack or pile as shown in the drawing are used. These cams cooperate with pin followers 64A carried by an arm 64 integral to a shaft 66, which is assembled on the frame 1 parallel to the axis of the needle cylinder. The pins 64A of the arm 64 are located on different levels to cooperate with successive superimposed cams in the several positions during a cycle of the pattern drum 34.

The shaft 66 has an arm 68, which is provided at its end with an inclined plane profile 58A which can act on a follower 70, slidably assembled on the frame 1 parallel to the axis of the needle cylinder 3, to act on the end 24A of the above-described ring 24. Small angular movements of the unit 64, 66, 68 determine a slight axial movement of the follower 70 and thus a raising and a lowering of the ring 24 about its pivot 26; this determines an axial movement of the needle cylinder through the ball bearings 22. FIG. 1 shows a cam 72 of the drum 34 which has a very gradual profile and acts thereby in a very gradual manner on the unit 64A, 64, 66, 68, 70 to determine the slow movement of the needle cylinder in the axial direction, and thereby the slow variation of the length of loops being knit. The profile of the cams acting on the follower 64A can cause increasing and decreasing changes in the length of loops.

The other cams of the cam pack 36 assembled on the drum 34 serve to carry out the several controls of the cams acting on the needle and jack butts of the needle cylinder, as well as to effect picking and releasing of yarns and all the other movements which are typical of a conventional knitting operation.

For the control of the radially movable cams and their action on the jack and needle butts, there are provided followers 74, one for each of the cams formed by the drum 34, each follower 74 being assembled on a shaft 76 parallel to the axis of the needle cylinder and assembled movably on the frame 1. Each shaft 76 carries, in a suitable position above the level of the bearing 20, an arm 77 designed to act through an appropriate member 78 on the slide 80, which is mounted for radial sliding, to control the exclusion of the cam 81 of the cam shell arranged around the cylinder 3, against the counteraction of springs which tend to insert it. The different heights of the cams 36 enable the extraction, the partial insertion, the total insertion or the insertion at different levels of cams such as those 84 or the like. Other cams of the drum act on followers 82 integral to arms 83, which arms 83 act on radial extensions 85A of angularly movable cams 85. Arrangements of this type are arranged at different positions around the circumference of the needle cylinder to effect the controls of the cams in the different positions in which they are located in the needle cylinder.

Arrangements similar to those described serve to operate yarn guides, wherein followers 88 similar to the followers 74 are mounted on shafts 90 similar to the shafts 76 and extending to the annular element 7 to operate forks 92 for the hereinafter indicated purposes.

Figure 4:
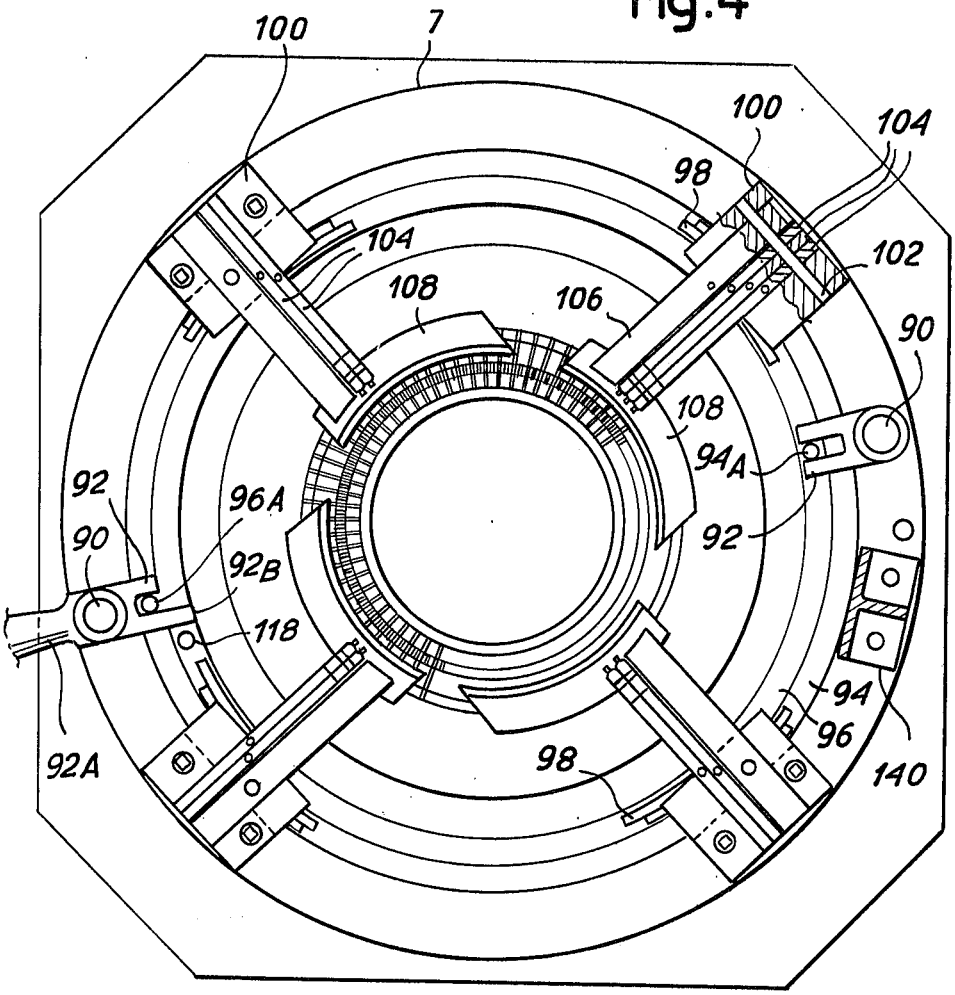

According to the example, there are provided two forks 92 substantially diametrically opposite. A housing is formed on the annular element 7 for two rings 94 and 96 mounted one within the other and angularly movable around their center which is located on the axis of the needle cylinder, the movement of the rings being determined by the control operated by the two forks 92. One of these forks engages a pin 96A of the outer ring 96 and the other one of the forks engages a pin 94A of the other one of the rings 94. On each of the two rings 94 and 96, there are provided at each of four yarn feeds corresponding cam profiles generically denoted by 98. There are four yarn feeds around the needle cylinder in the embodiment shown. In correspondence of each feed there is provided on the ring 7 a support 100, on which a plurality of lever members are articulated at 102 advantageously in a coaxial manner, with the members extending toward the cylinder 3. Some of the levers 104 form yarn guides 104A, while at least one of them for each feed, indicated by 106, serves to carry a plate 108 for guiding and protecting the latches 110 of the needles 112 of the needle cylinder 3. In order to act on the levers 104 and 106 there are provided follower pins 114 guided on the support 100 and raisable by means of the profiles 98, to lift the levers 104 and 106 against the counteraction of springs 116 acting on the outer ends of the same levers. The springs 116 stress each of the levers 104 and 106 into active position and therewith the yarn guides 104A and the guide plates 108, the active position being defined by the corresponding feed bearing either on the pins 114 or on the support 100 of the corresponding feed. Through the control by the shafts 90 and the forks 92 there is an independent positioning of the two rings 94 and 96 and thereby the desired selection of the yarn guides as a function of the position of the raising and lowering profiles 98. One of the two forks 92 has a lever 92A for hand operation for the control of the outer ring 96, and also has one of its two arms 92B (see FIG. 4) longer than the other to be able to operate both rings 94 and 96, owing to the presence of a pin 118 on the ring 94 in such a manner as to determine manually the simultaneous movement of both rings 94 and 96. This simultaneous control serves to operate a full raising of all the levers 104 and 106 and of the guide plates 108, when it is necessary to gain access to the upper section of the needle cylinder, as required in the use of the machine.

Through the control systems of the cams 38 of the drum 34, control is obtained for the shell cams—such as the cams 81 and 85— acting on the needle and jack butts, and of the yarn guides as well as the exclusion of all the yarn guides and the plates 108 from the needle working zone, at the upper end of the cylinder. Control is also obtained, with the cams 72 acting on the followers 74A, of the variation of the loop length during certain working stages of the operation of the machine.

An appropriate program may be used to determine the advance stages of the pattern drum 34 and thereby the stages in which occurs a switching both in the shell cams, in the yarn guides and in the axial position of the cylinder for the variation of the length of loops. In order to obtain the variation of the loops with a high graduality, though keeping the angular space required for this operation within a limited extent, there is provided the small-pitch advance system with the ratchet wheel 40 having very close teeth. For the switching of the cams for the action on the yarn guides and on the shell cams, provision is made, on the contrary, for wider movements with the ratchet wheel 42. In any case, the jack advance movement operated for each revolution of the needle cylinder is selectively obtained for some of the program stages during the operating cycle, while for other stages of the cycle the drum 34 is kept stationary, as no switching is required.

In order to exclude the drum 34 from the advance movement, the followers 50 and 57 are lifted from their respective cams 44, 48 and 46, so as to interrupt the reciprocating angular movements of the followers and thus the advance of the drum. For this purpose, electromagnetically operated devices are designed which are, for all the followers 50 and 57, indicated at 122. These devices include electromagnets and permanent magnets designed to act on respective keepers 124 which approach to the pole shoes of the magnets 122 during the radial movement towards the outside of the respective followers and which are left free or retained according to the energization conditions of the electromagnetic devices. For a safe operation (in the event of a power failure), the electromagnetic devices operate to retain the respective followers and thus the respective keepers 124 by action of a permanent magnet, whose action is neutralized by the energization of a winding, which in this way — when energized — allows the operation of the follower while in absence of power, the follower 50 is attracted and thus the interruption of the oscillation is determined.

A suitable program allows to effect the actuation of the several quick-pitch or slow-pitch advance systems according to the requirements of the working cycle of an article. In this way, the periphery of the drum 34 is sufficient to obtain working programs for a working cycle. The program which acts on the electromagnets may be of the electric type (punched tape or the like) or of the mechanical type, for instance of the chain-type.

FIGS. 6 to 24 show the operation of the needle latch guide plate 108 and the way of feeding the yarn F to the needles at any feed, so as to show how this yarn is fed without contacting any member of the respective feed, but being directly supplied to the needle which is to pick it up. In these figures, where the arrows indicate the relative movement of the needles with respect to the plate 108 and the yarn guides 104A, it is noted that during the raising of the needles 112 to reach a yarn guide 104A, a latch-opener 126 acts on the latches of the needles being raised to maintain them open. This results in the latch being open and below the plate 108, when the needle reaches the edge thereof.

The presence of the inner edge of the plate 108 prevents the latch 110 from accidentally being raised again and closing the end hook of the needle which is to pick the yarn up. The position of the yarn guide 104A with respect to the plate 108 and to the trajectory of the needles is such (see FIGS. 7 to 10 and 12 to 24), that the guide in practice does not touch either the inner edge of the plate 108 or any other element connected to the respective yarn feed, arriving directly at the needle which is to pick it up and form the loop by its lowering. This avoids on one hand undesirable yarn damage and on the other hand the wear of the members which might contact the yarn. The same inner edge of the plate 108 is not particularly subjected to wear-stress, as the possible contact of the needle latch is accidental, not systematic. This results in a positive operation of the yarn feeds and a substantial simplicity of the different members connected with each of the yarn feeds, while any breakdown of the latches is avoided.

When replacing the yarns by means of the operation of the yarn guides 104, 104A to insert or remove yarns, it is necessary to cut the yarns, which is usually effected — according to conventional arrangements — by means of a disc-saw yarn cutter formed by a disc-like or annular element having a saw-tooth gear designed to engage the yarn to be cut and to carry it towards a cutting knife, or towards one or the other of a plurality of cutting knives provided around the circumference of the toothed disc, the latter being located in the interior of the annular path of the upper end of the needles. The annular saw, that is circular saw, must rotate substantially at the speed of the needle cylinder, so as to effect a satisfactory cutting as to the length of the yarn residual piece coming out of the knitted fabric. Usually these saws are mounted on a disc, which in a simple machine as the one now being described is not provided, as there is no requirement for the operation conventionally entrusted to this disc. Thus, in replacement of the disc there is provided a device, particularly shown in FIGS. 27 to 31, which serves to cut the yarns and is caused to intervene at the moment when the yarn is to be cut.

This cutting device includes a supporting arm 140 projecting from the fixed annular element 7 borne by the frame 1, and extending to the area of the extension of the needle cylinder axis. In an end head 140A of the support 140 there is provided a housing coaxial to the needle cylinder axis for a column 142 which can slide with respect to the head 140A and is fixed against rotation. The column 142 is urged upward by a spring 144 which by pressing on the head 140A pushes upwardly a plate 146 integral to the upper end of the column 142. At the lower end of the column 142 there is an expanded head 142A, below which there is provided an upper plate 148 and a lower plate 150 both borne by a shaft 142 internal and coaxial to the column 142 and assembled for rotation therein. The column 142 is prevented from rotating by a groove 142B, in which coacts a dowel 154 borne by the head 140A. A disc 156 is mounted between the peripheries of the plates 148, 150 and projects outwardly therefrom with teeth formed around its periphery. The disc 156 is designed to cooperate with one or more of the conventional stationary cutting blades 158 carried by arms 160 integral to the head 142A. The lower plate 150 has a flared underneath profile which substantially corresponds to a frustum-cone portion of the inner profile of a ring 3B assembled in the interior of the upper end of the needle cylinder along which the fabric being formed is produced. The profile of the plate 150 has an annular groove or race for an annular resilient friction element 162 of rubber or the like, which can bear, upon lowering of the plate 150, on the inner frustum-cone surface of the ring 3B of the needle cylinder 3 with the fabric M under formation being inbetween (in particular see FIG. 27). On the upper plate 148 there is provided protecting piece 148A which rotates with the unit 148, 150, 152.

Figure 27:
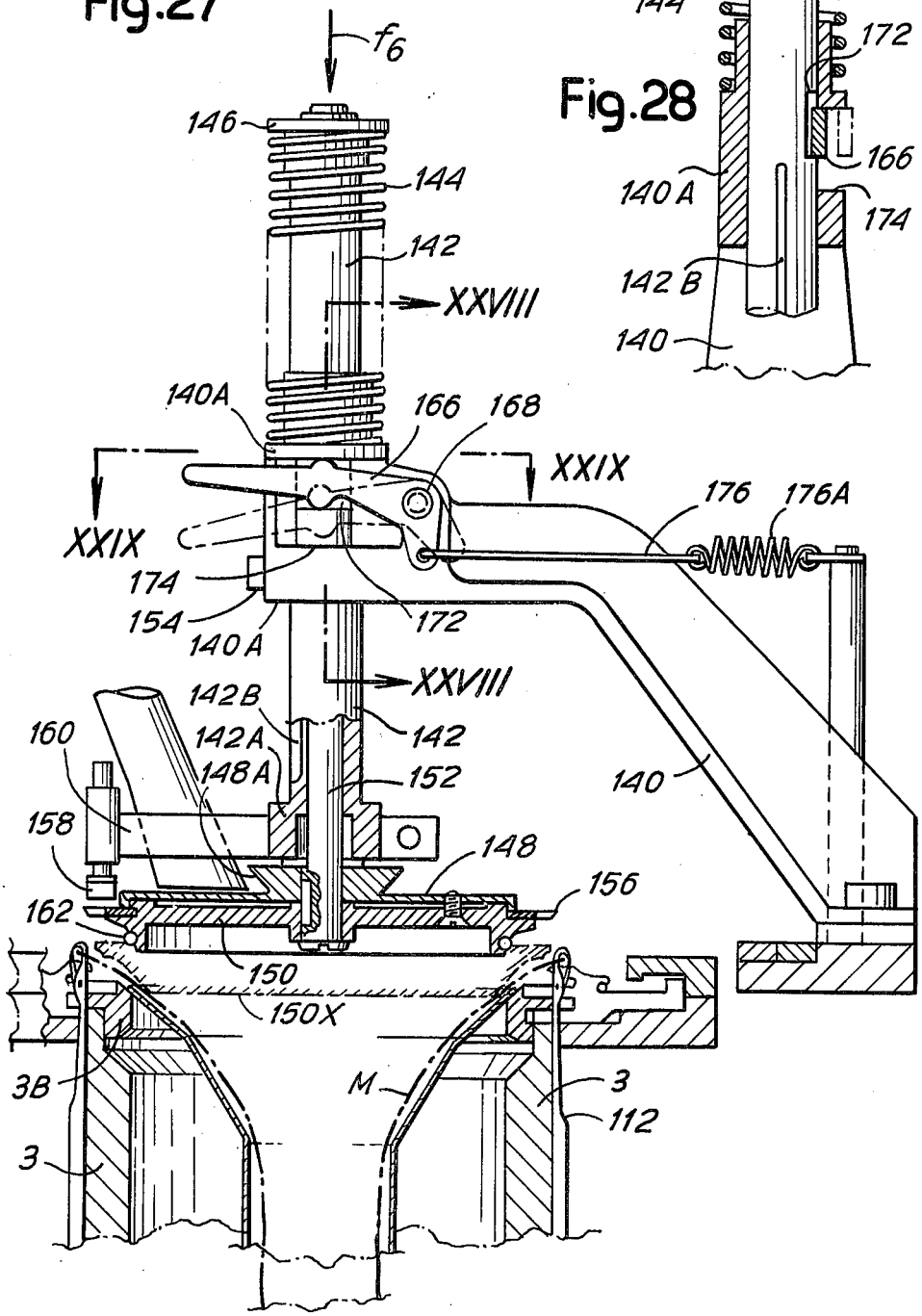
FIG. 27 is an elevational view, partially in section, of the upper end of the needle cylinder and associated elements and a yarn cutting mechanism mounted on the machine thereabove.

When the plate 150 is located in a position partly raised from the needle cylinder 3, as shown in FIG. 27 in full line, the disc 156 is stationary together with the unit 150,152. When the plates 148 and 150 are lowered to a position indicated at 150X in FIG. 27 the annular friction element 162 engages the ring 3B of the needle cylinder 3 and is rotated thereby. In the lowered position 150X of the plate 150, the disc 156 reaches the active position for the cutting of the yarn together with one or the other of the knives 158, which have been lowered, together with the lower plate 150, with the column 142 in the hereinafter described manner. Thus, yarn is cut when, by action of the program, a lowering of the plate 150 is determined from the position shown in full lines in FIG. 27 to the position 150X indicated in dash lines in the figure.

In order to effect the movement of the column 142 from the raised position to the lowered position, a small lever 166 is provided on the head 140A of the arm. This lever 166 is pivoted on a pin 168, with respect to which the lever can be bent laterally outward as well as pivoted as clearly shown by the comparison between FIGS. 29 and 30. A small spring 170 tends to press the small lever 166 to the position shown in FIG. 29, that is towards and against the column 142. This column has a notch 172, which corresponds to a cut-out 174 of the head 140A and to the side of the lever 166, which is urged against the column 142 by the small spring 170. A tie-rod 176 with a spring 176A acts on the lever 166 and also the operator can act to separate the lever from the column 142 against the action of the spring 170.

Figure 28:
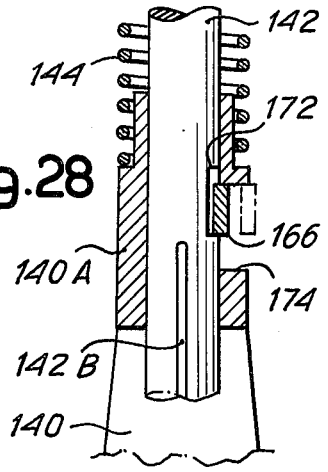
FIG. 28 is a vertical sectional view of a portion of FIG. 27 as viewed along line XXVIII—XXVIII of FIG. 27.
Figure 29:
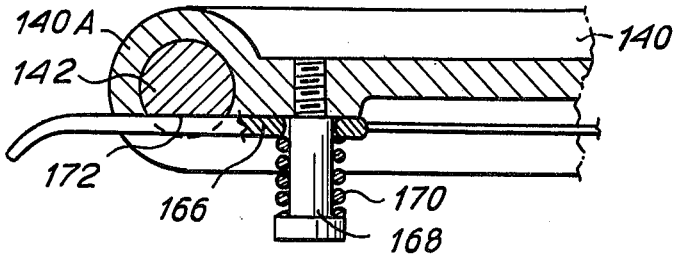
FIG. 29 is a vertical sectional view taken along line XXIX—XXIX of FIG. 27.

When the device is under the working conditions shown in FIGS. 27 to 29, the lever 166 is located in the notch 172 of the column 142, and in the raised position of the plate 150, as shown in FIG. 27, the spring 144 tends to raise the unit 142, 148 towards the top, against the counteraction of the lever 166 which is located between a side of the notch 172 and the upper edge of the cut-out 174. The device is thus ready for the operation of the yarn cutter by lowering of the plate 150 and rotation of the saw 156 by operation of the tie-rod 176, either directly by the program by means of an electromagnetic servomotor or the like, or by means of a cam of the drum 34 (which may be a cam combined to the yarn guide control system) in such a manner as to act on the lever 166 through the spring 166A to lower the column 142, overcoming the action of the spring 144. The elastic tension 176A causes the annular element 162 to contact by pressure the ring 3B of the needle cylinder, and thereby the plate 150 and then the disc 156 of the saw are rotated by the needle cylinder by frictional action, and the yarn cut effected with the temporary rotational actuation of the disc 156 in cooperation with the stationary knife blade 158. Upon ceasing by the returning of the tie-rod 176A, the same spring 144 returns the unit of the column 142 and of the plate 150 into the raised position shown in FIG. 31. The disc 150, accordingly, is rotated only when the yarn is being cut. The protecting piece 148A of the portion 148 is engaged by the yarn, which is thus tensioned by the action which is exerted thereon by the annular groove in the piece 148A.

Figure 30:
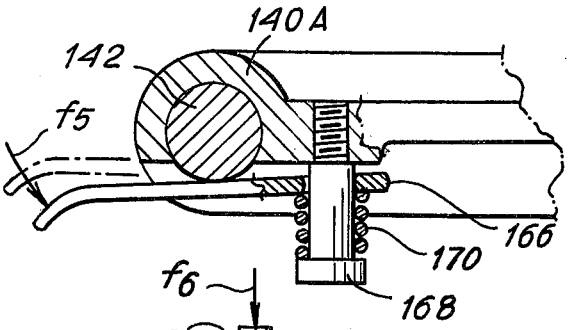
FIG. 30 is a view similar to FIG. 29 showing the elements in an alternate position.
Figure 31:
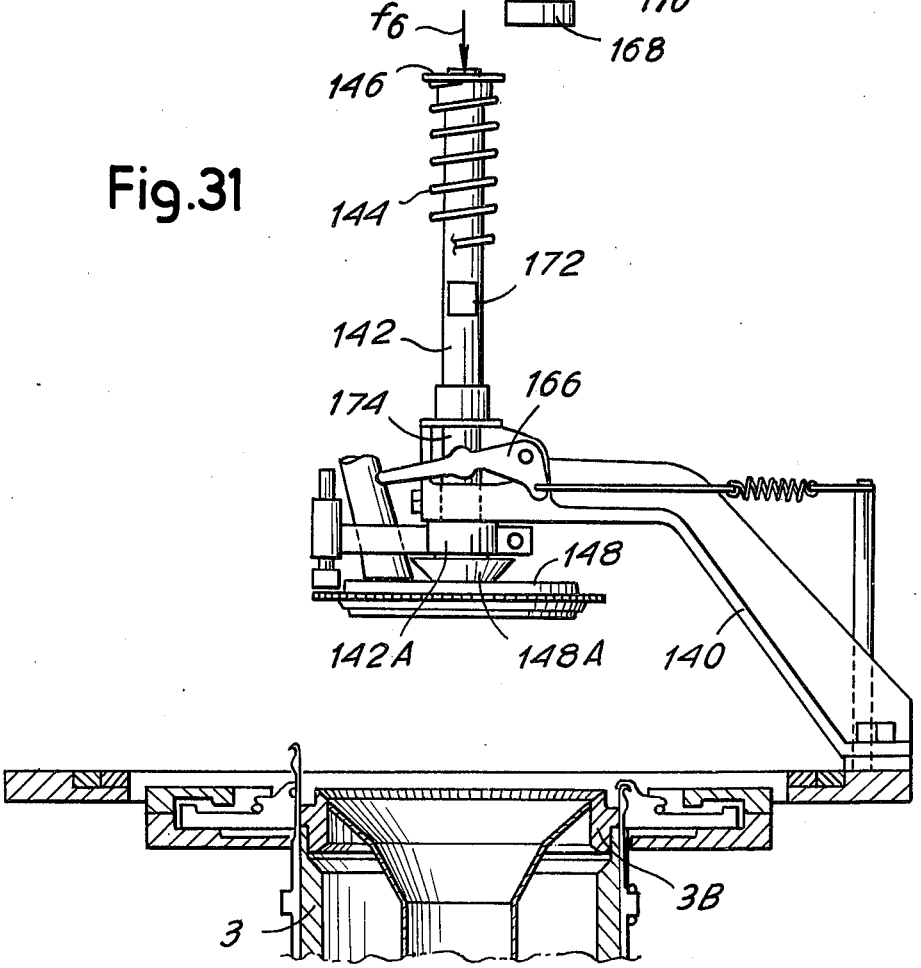
FIG. 31 is a view similar to FIG. 27 on a reduced scale showing the yarn cutting mechanism in a raised inoperative position.

When it is necessary to gain access to the upper section of the needle cylinder, that is when all the yarn guides and all the plates 108 are raised, or for any other requirements it must be possible to raise the plate 150 and the disc 148, it is necessary only to act on the lever 166 in the direction of the arrow f5 of FIG. 30 in such a manner as to separate the lever 166 against the action of the spring 170 from the notch 172 of the column 142. Under these conditions, the column 142 is no longer retained by the lever 166, and thus the spring 144 causes it to fully rise to the position in which the head 142A of the column 142 strikes against the head 140A of the arm 140. To lower the unit the head 146, is lowered in the direction of the arrow f6 of FIG. 31, to bring the notch 172 in correspondence with the lever 166, and trip the latter, through the spring 170, into the notch 172 to lock the device again in the arrangement for controlled movement between an inoperative position adjacent the needle cylinder (solid lines in FIG. 27) and an operative position (dash lines in FIG. 27) engaging the cylinder to effect yarn cutting.

It is intended that the drawing only shows an embodiment given just as a practical illustration of the invention, said invention being in conditions as to be varied in the forms and arrangements without however, departing from the scope of the concept characterizing the same invention.

I claim:

1. In a circular knitting machine of the rotating needle cylinder type, patterning means comprising a pattern drum rotatably mounted on the machine coaxial with and underlying the needle cylinder, ratchet means mounted on said pattern drum, said ratchet means comprising a plurality of ratchet wheels having different pitches, and means responsive to needle cylinder rotation and engagable with said pattern drum to advance said pattern drum, said responsive means including cam means mounted on said cylinder and follower means engagable with said cam means in following relation thereto, said follower means including pawl means engagable with said ratchet means to advance said pattern drum in response to said following relation, and said pawl means including a plurality of pawls engagable with said ratchet wheels and with said follower means imparting different strokes through said pawls to said ratchet wheels.

2. In a circular knitting machine, patterning means according to claim 1 and characterized further in that said responsive means comprises a plurality of cams mounted on said cylinder, and said follower means includes a plurality of followers engagable with said cams in following relation thereto and operable to advance said pattern drum in response to said following relation and characterized further by means for intermittently deactivating said follower means to produce intermittent operation of said pattern drum, said intermittently deactivating means comprising a plurality of deactivating devices connected to said follower for selectively and independently displacing said followers out of cam following relation, each of said deactivating devices comprising an independently operable electromechanical unit including a permanent magnet and an electromagnet, whereby energization of the electromagnet neutralizes the permanent magnet allowing the follower to engage the cam and advance the drum, and whereby deenergization of the electromagnet causes the permanent magnet to attract the follower and interrupt the oscillation thereof by the cam thereby preventing advancement of the drum.

3. In a circular knitting machine of the type having a plurality of needles and needle jacks with each needle and jack having a butt carried by the needle cylinder, patterning means according to claim 1 and characterized further by at least one shaft rotatably mounted on the machine parallel to the cylinder and drum axis, cam and follower means connecting said pattern drum and said shaft for oscillating said shaft, an arm mounted on said shaft and engagable with a radial cam of the machine for engagement with needle and jack butts on the machine.

4. In a circular knitting machine of the rotating needle cylinder type, patterning means comprising a pattern drum rotatably mounted on the machine coaxial with and underlying the needle cylinder, means responsive to needle cylinder rotation and engagable with said pattern drum to advance said pattern drum, said responsive means including cam means mounted on said cylinder and follower means engagable with said cam means in following relation thereto and operable to advance said pattern drum in response to said following relation, a shaft rotatably mounted on the machine parallel with the cylinder and drum axis, cam and follower means connecting said pattern drum and said shaft for oscillating said shaft, and an arm mounted on said shaft for oscillation therewith and having a surface inclined to said axis for displacing the cylinder axially upon oscillation of said shaft to adjust the length of loop knit by the machine.

* * * * *